US008865986B1

(12) United States Patent
Twyford

(10) Patent No.: US 8,865,986 B1
(45) Date of Patent: Oct. 21, 2014

(54) JAZZ FLAT RIDE AND METHODS OF MAKING THE SAME

(71) Applicant: Jerry A. Twyford, Springfield, MO (US)

(72) Inventor: Jerry A. Twyford, Springfield, MO (US)

( * ) Notice: Subject to any disclaimer, the term of this patent is extended or adjusted under 35 U.S.C. 154(b) by 0 days.

(21) Appl. No.: 13/679,174

(22) Filed: Nov. 16, 2012

(51) Int. Cl.
*G10D 13/08* (2006.01)
*G10D 13/06* (2006.01)

(52) U.S. Cl.
CPC ..... *G10D 13/06* (2013.01)
USPC ..... 84/402; 84/411 R

(58) Field of Classification Search
USPC ..... 84/402
See application file for complete search history.

(56) References Cited

U.S. PATENT DOCUMENTS

| | | | | |
|---|---|---|---|---|
| 4,807,510 | A * | 2/1989 | Croteau | 84/402 |
| D301,893 | S | 6/1989 | Hargrove | |
| 4,911,056 | A | 3/1990 | Belli et al. | |
| 6,034,313 | A | 3/2000 | Shelley | |
| 6,310,277 | B1 * | 10/2001 | Shelley | 84/422.3 |
| 6,828,496 | B2 | 12/2004 | Paiste | |
| D523,466 | S * | 6/2006 | Anderson | D17/22 |
| D538,838 | S * | 3/2007 | Scharte | D17/22 |
| 7,199,297 | B2 | 4/2007 | Anderson | |
| 7,518,050 | B2 * | 4/2009 | Stannard | 84/402 |
| 7,626,106 | B2 * | 12/2009 | Stannard | 84/422.1 |
| 2008/0105104 | A1 * | 5/2008 | Stannard | 84/402 |

OTHER PUBLICATIONS

Model EFX cymbal, Avedis Zildjian Company, International Headquarters, 22 Longwater Drive, Norwell, MA 02061.

Model EFX cymbal, Avedis Zildjian Company, International Headquarters, 22 Longwater Drive, Norwell, MA 02061, Date found Nov. 11, 2011.

* cited by examiner

*Primary Examiner* — Christopher Uhlir
(74) *Attorney, Agent, or Firm* — Richard L. Marsh

(57) ABSTRACT

A jazz ride is a flat plate from a mounting hole to a peripheral edge wherein at least one segment is provided with a plurality of narrow annular slots separated by annular webs. The jazz ride may be a circular flat plate provided with multiple segments of different angular length.

20 Claims, 2 Drawing Sheets

JAZZ FLAT RIDE AND METHODS OF MAKING THE SAME

BACKGROUND OF THE INVENTION

1. Field of the Invention

This invention relates to a flat cymbal, commonly called a Jazz Flat Ride, and a method of making the same. The jazz ride of this application preferably comprises a flat metallic pie shaped segment of a defined angular length perforated with annularly disposed slots. The jazz ride of this application may also be a flat metallic disc with pie shaped segments wherein each pie shaped segment has a defined angular length and each pie shaped segment is perforated with annularly disposed slots.

2. Prior Art Statement

It is known to provide a flat ride provided with a series of circular holes at various distances from a central mounting hole and arranged within three identical segments of the cymbal wherein the segments are created between three oval radial slots spaced from a central mounting hole. The holes and slots are laser cut into a conventionally shaped cymbal wherein a bell is elevated above the portion carrying the holes and slots. Multiple diameters are available from Avedis Zildjian Company, International Headquarters, 22 Longwater Drive, Norwell, Mass. 02061. It is readily apparent that the segments are identical in angular length and thus the cymbal has one distinct sound. Furthermore, the slots and holes are sufficiently large as to capture a head of a drumstick. Therefore, there is a great need for a jazz ride that is flat from the mounting hole to the peripheral edge, is provided with segments of different angular length and has at least one narrow annular slot in each segment.

It is known to provide a cymbal comprising a flat steel plate in the shape of a Maltese Cross though other shapes are mentioned. The arms of the cross each have a different sized opening formed through the arms and the openings may be varied in shape to produce a different tone. Tambourine type jingles may be affixed to any or all of the holes in the arms to modify the sound. Many different metals are mentioned as possible for the plate. For instance, see the U.S. Pat. No. 7,199,297 B2, issued on 3 Apr. 2007 to James M Anderson. Though the plate is flat, has a plurality of arms and is provided with a hole in each arm, the arms are identical and must be modified in order to produce different sounds. There is still a need for a flat jazz ride that comprises a single circular plate having different sized segments each provided with at least one narrow annular slot.

It is known to vary the surface of a conventional hammered cymbal by passing milling cutters over the raised portions of the hammered surface to produce grooved structures. The grooved structures are annular separated by "flat" segments and may extend across the entire face of the cymbal or only in certain segments, like the outer rim. The varied groove structures may also be discontinuous within the annular segments and may be combined with continuous groove structures on the same disc. The varied groove structures do not penetrate the material of the cymbal. For instance, see the U.S. Pat. No. 6,828,496 B2, issued on 7 Dec. 2004 to Robert Paiste. Another conventional cymbal is provided with pits in the surface of the cymbal. For instance, see the U.S. Design Patent D301,893 issued to James V. Hargrove on 27 Jun. 1989. These devices are conventional in shape having an umbrella like ring and a central domed cupola and though a different sound is produced with each cymbal, there is still only one sound for a given cymbal. Therefore, the need for a jazz ride that is flat from the mounting hole to the peripheral edge, is provided with segments of different angular length and has at least one narrow annular slot in each segment to produce different sounds from various segments and within each segment is still great.

It is known to provide a flat ride provided with radial tonal grooves extending from the central opening toward the outer rim with the spacing, depth and width of the radial tonal grooves depending upon the sound and tone desired. The radial tonal grooves or ridges are arranged in angular segments around the ride and may be varied in angle. The flat ride may also have ridges in place of, or in combination with grooves and also may be provided with pits in the surface of the ride. The bell of the ride, if so produced, may also be provided with pits, grooves, ridges or combinations thereof. For instance, see the U.S. Pat. No. 6,034,313 issued on 7 Mar. 2000 to Thomas W. Shelley. Each ride produced by the teachings of this patent will have a distinct sound and thus different rides are needed for each different sound. Accordingly, there is still a great need for a jazz flat ride that is capable of producing different sounds from each of a plurality of segments and from within each segment.

Finally, it is known to provide a cymbal type instrument comprising an outer peripheral rim and a plurality of spokes emanating from a central support. The outer rim is not in the same plane as the central support nor are the segments necessarily of the same angular length. The space between the outer rim and the central support is substantial. For instance, see the U.S. Pat. No. 4,911,056 issued to Belli, et al., on 27 Mar. 1990. Each cymbal type instrument will produce a distinct sound or set of sounds however, in order to produce a great plurality of sounds, additional instruments are needed. Therefore, the need for a single flat ride capable of producing a plurality of sounds within a segment or across segments is still needed.

SUMMARY OF THE INVENTION

One object of this invention is to provide a jazz ride that is flat from the mounting hole to a peripheral edge and comprises a pie shaped segment of a specified angular length wherein the segment has a plurality of narrow annular slots disposed therethrough.

Another object of this invention is to provide a jazz ride comprising a circular flat plate, said flat plate provided with a plurality of annular slots therethrough, said annular slots separated by solid annular webs, said annular slots and said solid annular webs arranged in segments extending from a solid central support to a solid outer rim, said segments separated by radial edges wherein said radial edges are spaced at angles around said circular plate wherein said annular slots and said solid annular webs in said segments produce distinct sounds.

Yet another object of this invention is to provide a jazz ride that is flat from the mounting hole to a peripheral edge wherein the pie shaped segments are of different angular length wherein each segment has at least one narrow annular slot disposed therethrough.

A primary goal of this invention is to provide a jazz ride by water jet cutting a plurality of annular slots through a metallic flat plate wherein the annular slots are separated by solid annular webs. The metallic flat plate may be a circular disc having annular webs and annular slots extending from a solid central support to a solid outer rim wherein the disc is divided into segments which are separated by radial edges wherein the radial edges are spaced at various angles around the circular plate.

One aim of this invention is to provide a flat jazz ride of segments of different angular length ranging from about 10 degrees to about 90 degrees wherein each segment and has a plurality of narrow annular slot ranging in width from about one thirty second of an inch to about one quarter of an inch.

DESCRIPTION OF THE PREFERRED EMBODIMENTS

Figure 2:
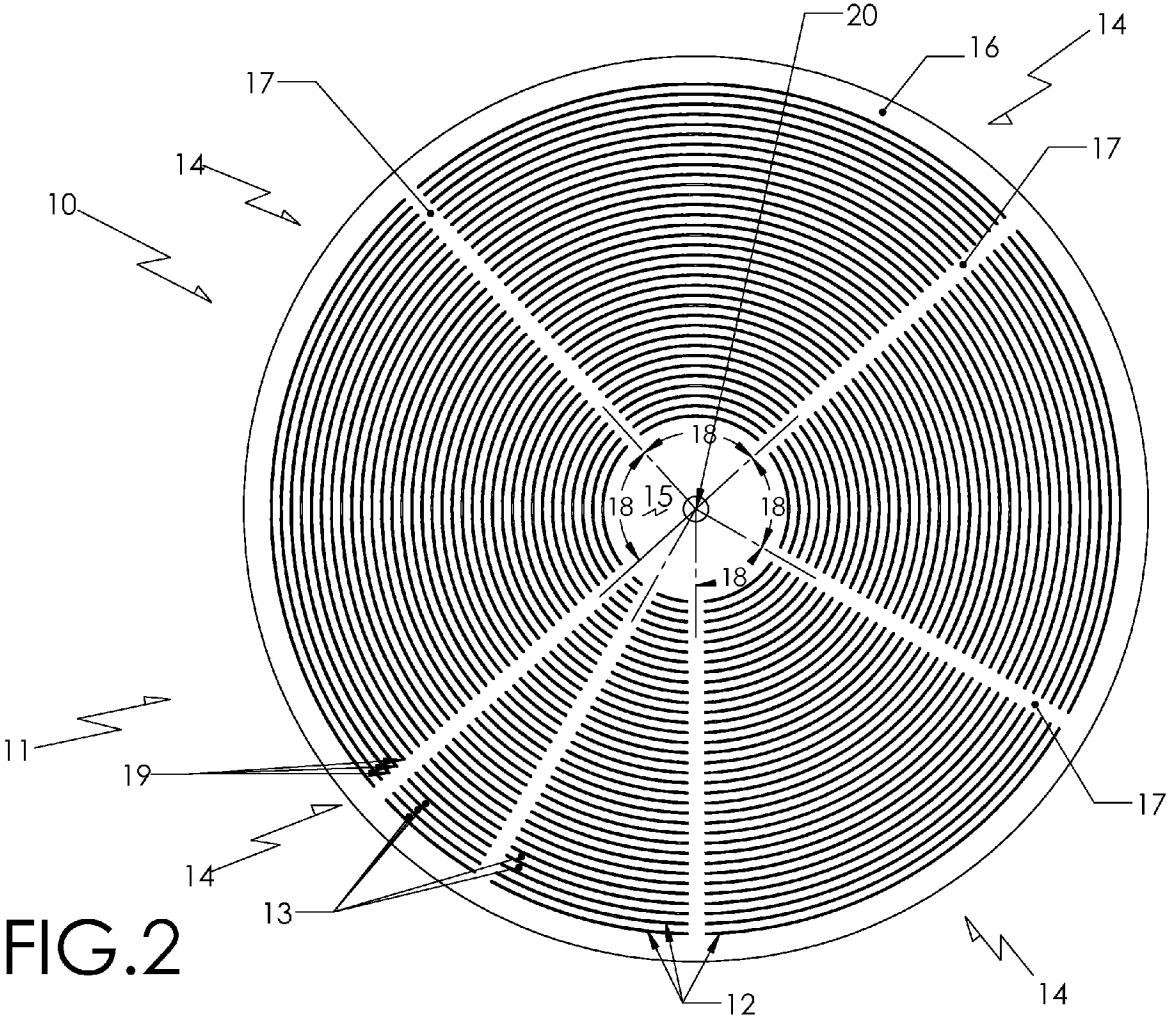
FIG. 2 is a top plan view of an alternate embodiment of the jazz flat ride of this invention.

Referring now to FIG. 2, a jazz ride, generally shown as number 10, comprises a circular flat plate 11, flat plate 11 provided with a plurality of annular slots 12 therethrough. Annular slots 12 are separated by solid annular webs 13 wherein annular slots 12 and solid annular webs 13 are arranged in segments 14 extending from a solid centrally located support portion 15 to a solid outer rim 16. Segments 14 are separated by radial edges 17 wherein radial edges 17 are spaced at angles 18 around circular flat plate 11. Annular slots 12 are from about 0.005 inch to about 0.200 inch in width and solid annular webs 13 are from about 0.125 inch to about 0.500 inch in width. In the embodiment shown in FIG. 2, annular slots 12 are from about 0.035 inch to about 0.055 inch in width and solid annular webs 13 are from about 0.08 inch to about 0.215 inch in width. Annular slots 12 are preferably terminated at radial edges 17 with a rip stop 19, however, annular slots 12 may be terminated at radial edges 17 at the same width. Radial edges 17 are preferably about 0.200 inch in width, however, radial edges 17 may be either wider or narrower. Jazz ride 10 is provided with a hole 20 through support portion 15 of flat plate 11, hole 20 provided for mounting jazz ride 10 to a cymbal stand. Hole 20 is shown as centrally located in flat plate 11, however it is fully within the scope of this invention to put hole 20 at any location within centrally located support portion 15. Solid annular webs 13 with annular slots 12 therebetween within segments 14 produce distinct sounds when struck at a given point with a drumstick and other distinct sounds when struck with drum brush.

As annular slots 12 and solid annular webs 13 decrease in angular length from outer rim 16 to centrally located support portion 15, shorter solid annular webs 13 in each given segment 14 produce yet other distinct sounds relative to longer solid annular webs 13 within a given segment 14. Jazz ride 10 may have as many segments as desired, however six segments 14 are shown in FIG. 2, each segment 14 of a different angular length as established by angles 18. Angles 18 may range from about ten degrees (10°) up to about 350° and may be arranged from smallest to largest angular length counterclockwise around jazz ride 10. If clockwise arrangement is desired, it is a simple matter to flip over the plate and remount. Angles 18 may also be equal in angular length wherein tonal differences may be gained by moving inwardly or outwardly along any given segment 14, however, angles 18 of circular flat plate 11 are preferably varied circumferentially around flat plate 11. In the embodiment shown in FIG. 2, six segments 14 are provided at angles 15°, 30°, 45°, 60°, 90°, 120° respectively, annular slots 12 are 0.040 inch in width, solid annular webs 13 are 0.187 inch in width, flat plate 11 is 15 inches in diameter, centrally located support portion 15 is 3½ inches in diameter and flat plate 11 is 0.080 inch thick. It should be fully understood, however, that flat plate 11 may be thicker or thinner, centrally located support portion 15 may be larger or smaller in diameter, segments 14 may be of different angular length, flat plate 11 itself may be larger or smaller in diameter and as described above, annular slots 12 and/or annular webs 13 may be larger or smaller.

Furthermore, segments 14 defined by angles 18 may be arranged circumferentially around flat plate 11 in clockwise ascending angular displacement sequence such that the frequency of each segment 14 is in descending order, however counterclockwise arrangement is certainly within the scope of this invention as well as random arrangement of the segments 14. Preferably, within each segment 14, the width of annular slots 12 are equal and the width of solid annular webs 13 are equal, however it is fully within the scope of this invention to vary the width of annular slots 12 from outer rim 16 to centrally located support portion 15 and/or to vary the width of solid annular webs 13 from outer rim 16 to centrally located support portion 15 as hereinafter described.

Figure 1:
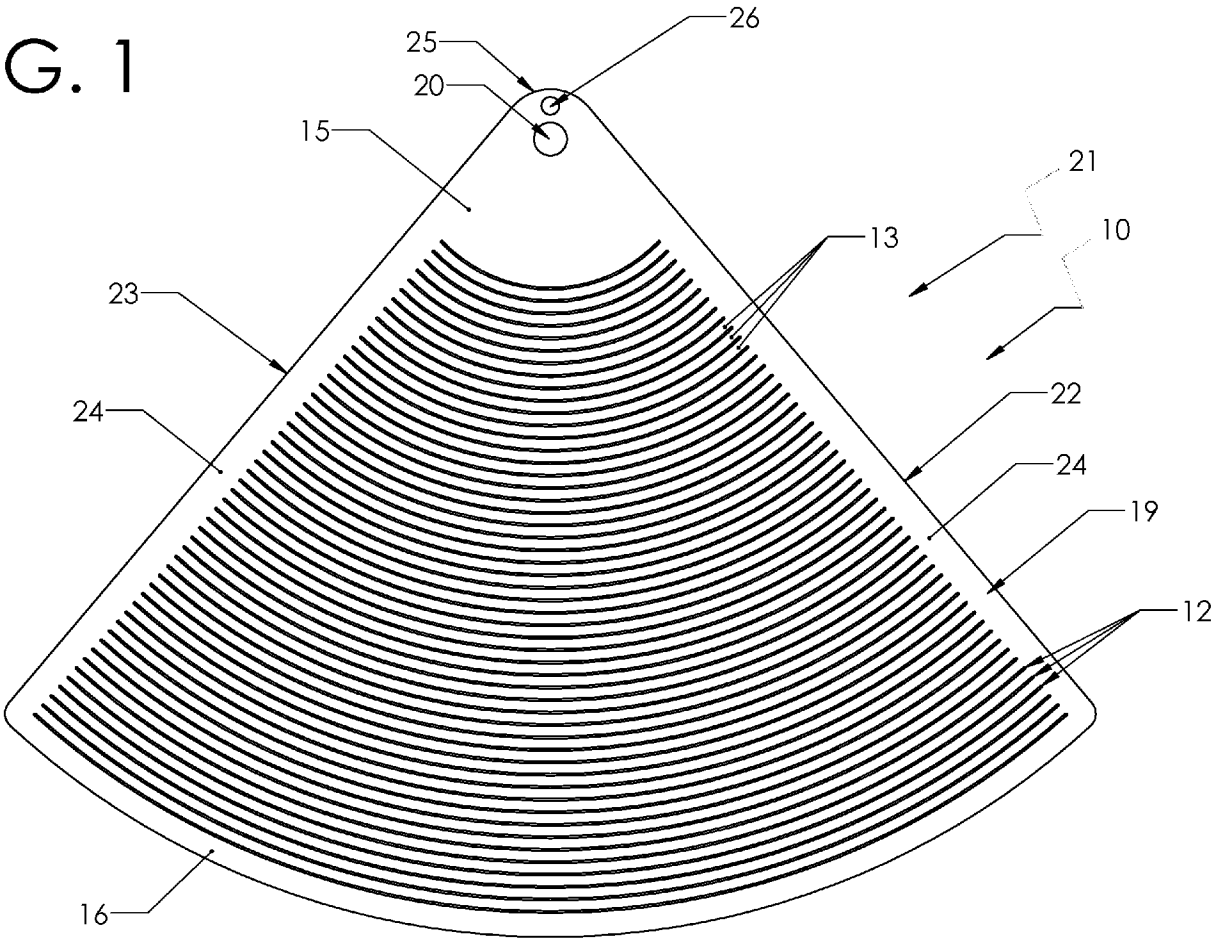
FIG. 1 is a top plan view of the preferred embodiment of the jazz flat ride of this invention.

Referring now to the preferred embodiment of FIG. 1, jazz ride 10 is preferably only a segment 21 of a circle and most preferably from about 45 to 120 degrees in angular length though jazz ride 10 may be substantially a full circular plate up to 359 degrees or even a full circular plate 11 as hereinbefore described and as shown in FIG. 2. Segment 21 is provided with a plurality of annular slots 12 therethrough. Annular slots 12 are separated by solid annular webs 13 wherein annular slots 12 and solid annular webs 13 extend from support portion 15 to solid outer rim 16. Support portion 15 is provided with mounting hole 20 disposed inwardly of the apex 25 of segment 21, mounting hole 20 adapted to receive a post of a cymbal stand therethrough. Support portion 15 is also provided with a second hole 26 disposed between mounting hole 20 and apex 25, second hole 26 adapted to receive an anti-rotation hook therein. As with the embodiment shown in FIG. 2, annular slots 12 of segment 21 are from about 0.005 inch to about 0.200 inch in width and solid annular webs 13 are from about 0.125 inch to about 0.500 inch in width. In this preferred embodiment, annular slots 12 are also from about 0.035 inch to about 0.055 inch in width and solid annular webs 13 are from about 0.195 inch to about 0.215 inch in width. Annular slots 12 are preferably terminated at radial edges 24 with a rip stop 19, however, annular slots 12 may be terminated at radial edges 24 at the same width and may be slightly rounded due to the cutting process described hereinafter. Radial edges 24 are preferably about 0.200 inch in width, however, radial edges 24 may be either wider or narrower. Again, as with the embodiment in FIG. 2, as annular slots 12 and solid annular webs 13 decrease in angular length from outer rim edge 16 to support portion 15, shorter solid annular webs 13 in segment 21 produce distinct sounds relative to longer solid annular webs 13 within a segment 21.

As hereinbefore stated, annular slots 12 and/or annular webs may be changed to provide for different sounds. For instance, in a first alternate embodiments, annular slots 12 may be increased in width from outer rim 16 to support portion 15 by a fixed amount while the width of solid annular webs 13 remains constant such that the tone of segments 14, 21 is different from tone of segments 14 of the embodiment of FIG. 2 or the tone of segment 21 of FIG. 1, respectively. Likewise, in a second alternate embodiment of jazz ride 10, solid annular webs 13 may be increased in width from outer rim 16 to centrally located support portion 15 by a fixed amount while the width of annular slots 12 remains constant such that the tone of segments 14, 21 is different from the tone of segments 14 of the embodiment of FIG. 2 or the tone of segments 14 in the first alternate embodiment described immediately above or the tone of segment 21 of the preferred embodiment of FIG. 1. Similarly, a third embodiment of jazz ride 10 may be created by decreasing the width of annular slots 12 from outer rim 16 to centrally located support portion 15 while holding the width of solid annular webs 13 constant and a fourth embodiment created by decreasing the width of solid annular webs 13 from outer rim 16 to centrally located support portion 15 while holding the width of annular slots 12 constant. Of course, it is fully within the scope of this invention to create yet additional embodiments of jazz ride 10 by randomly varying the width of annular slots 12 within segments 14, 21, randomly varying the width of solid annular webs 13 within segments 14, 21, randomly varying the width of both annular slots 12 and solid annular webs 13 within segments 14, 21 as well as varying the width of either annular slots 12 and/or solid annular webs 13 within only one, or only certain segments 14 of the embodiment in FIG. 2. Thus, jazz ride 10 may take many configurations wherein the sound of segments 14, 21 is changed by the method selected from the group described above.

Though jazz ride 10 has been described as a segment of a circle or a circular plate, it is certainly within the scope of this invention to provide jazz ride 10 as a polygonal piece wherein a width and shape of outer rim 16 and radial edges 24 are dictated by the particular polygonal form. For instance, where jazz ride 10 is triangular, outer rim 16 decreases in width in both directions from radial edges 24 whereas when jazz ride 10 is provided as a rectangular piece, outer rim 16 increases in width in both directions from radial edges 24. In all shapes, annular slots 12 and annular webs 13 preferably decrease in arcuate length from outer rim 16 to support 15. A plurality of triangular segments 19 joined or made together at support 15 provides a polygonal plate for jazz ride 10 wherein each triangular segment 19 has a different angular width from radial edges 24 and thus also has a different sound on each segment 19 as well as different sounds within each segment 19 from support 15 to outer rim 16.

In a method of making jazz ride 10, a flat plate of material is selected for a given thickness, preferably in the range of 0.030 to 0.250 inch and most preferably about 0.060 inch in thickness. Jazz ride 10 is preferably selected from the group of rigid materials consisting of metals, thermoplastics, wood, carbon fiber, stone, glass, fibrous materials and composites or combinations thereof. More specifically, the material for jazz ride 10 is derived from a flat sheet of material selected from the group consisting of iron, steel, tin, aluminum, stainless steel, copper, zinc, titanium and alloys thereof and most preferably from a flat sheet of stainless steel. If produced at less than 90 degrees, four jazz rides 10 of FIG. 1 may be made from a single circular flat plate of material or alternately each jazz ride 10 may be cut from a rectangular strip of material with left edge 22 disposed along a side edge of the rectangular strip and a right edge 23 disposed at an angle of 90 degrees or less to the side edge of the rectangular strip. It has been found that a desired sound is produced from a 0.060 inch thick stainless steel plate segment 21 of about 80 degrees, a width of annular slot 12 of 0.045 inch, a width of annular web 13 at 0.200 inch, a width of radial edge 24 of 0.200 inch, a radius of 1.75 inches for support portion 15 and a width of outer rim 16 of 0.200 inch. Though jazz ride 10 is preferably a segment of a circle as in FIG. 1, jazz ride 10 may assume other configurations as desired such as circular thus creating flat plate 11 of FIG. 2. In the embodiment of FIG. 2, flat plate 11 is from about 8 to 25 inches in diameter and most preferably cut to approximately 15 inches in diameter. Flat plate 11 may be cut by any known means of producing a circular plate from the selected material, however, flat plate 11 is preferably cut in a computer controlled water jet cutting machine. In the embodiment of FIG. 1, the rectangular strip may be advanced to a cutting position within the computer controlled water jet cutting machine and jazz ride 10 of FIG. 1 cut therefrom. In either instance, a width of each of annular slots 12 is first entered into the computer program controlling the water jet cutting machine and the width of each of solid annular webs 13 also entered. A size for support portion 15, is established, from about ½ inch to about 2.5 inches in radius and preferably about 1¾ inches in radius and the location of holes 20 and 25 (where used) is specified. A width of radial edges 17 or radial edges 24 is set in the program as well as the width of outer rim 16. For a circular jazz ride 10 of FIG. 2, angles 18 are entered into the program thus establishing the number of segments 14. The arrangement of segments 14 may then be specified in order to produced the selected embodiment for jazz ride 10. The computer program controlling the CNC thus determines the number of annular slots 12 and solid annular webs 13. Upon establishing the design parameters listed above, the water jet CNC is activated to cut the desired embodiment of jazz ride 10.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A jazz ride cymbal comprises a thin flat plate provided with a plurality of narrow annular slots, a plurality of annular webs, an outer solid rim, at least one radial edge, a support portion and a mounting hole wherein said narrow annular slots are disposed completely through said thin flat plate, said annular slots separated by said annular webs, said narrow slots and said annular webs terminating at said at least one radial edge and extending from said solid outer rim around said support portion, said mounting hole disposed through said support portion.

2. A jazz ride as in claim 1 wherein said thin flat plate is a segment of a circle from about 10 to about 120 degrees in angular length.

3. A jazz ride as in claim 2 wherein said segment is about 80 degrees in angular length.

4. A jazz ride as in claim 3 wherein said thin flat plate is from about 0.030 to 0.250 inch in thickness.

5. A jazz ride as in claim 4 wherein said annular slots are from about 0.035 inch to about 0.055 inch in width.

6. A jazz ride as in claim 5 wherein said annular webs are from about 0.095 inch to about 0.215 inch in width.

7. A jazz ride as in claim 6 wherein said at least one radial edge is about 0.200 inch in width.

8. A jazz ride as in claim 7 wherein said outer rim is about 0.200 inch in width.

9. A jazz ride as in claim 8 wherein a radius of said support portion is about 1.25 inches.

10. A jazz ride cymbal comprises a circular thin flat plate provided with a plurality pie shaped segments, a plurality of narrow annular slots, a plurality of annular webs, an outer solid rim, a plurality of radial edges, a support portion and a mounting hole wherein said pie shaped segments are separated by said radial edges, said pie shaped segments provided with said narrow annular slots and said annular webs, said narrow annular slots disposed completely through said thin flat plate, said annular slots separated by said annular webs, said narrow slots and said annular webs terminating at said radial edges and extending from said solid outer rim around said support portion wherein said mounting hole is disposed through said support portion.

11. A jazz ride as in claim 10 wherein said thin flat plate is from about 8 inches to about 25 inches in diameter.

12. A jazz ride as in claim 11 wherein said segments are from about 10 degrees to about 120 degrees in angular length.

13. A jazz ride as in claim 12 wherein said pie shaped segments comprise six segments disposed upon said thin flat plate.

14. A jazz ride as in claim 13 wherein said thin flat plate is from about 0.030 to 0.250 inch in thickness.

15. A jazz ride as in claim 14 wherein said annular slots are from about 0.035 inch to about 0.055 inch in width.

16. A jazz ride as in claim 15 wherein said solid annular webs are from about 0.095 inch to about 0.215 inch in width.

17. A jazz ride as in claim 16 wherein said radial edges are about 0.200 inch in width.

18. A jazz ride as in claim 17 wherein said outer rim is about 0.200 inch in width.

19. A jazz ride as in claim 18 wherein a radius of said support portion is about 1.5 inches.

20. A method of producing a jazz ride cymbal comprises the steps of cutting a circular thin flat plate, the step of dividing said thin flat plate into a plurality pie shaped segments, the step of cutting a plurality of narrow annular slots through said circular thin flat plate in each of said pie shaped segments between an outer solid rim and a support portion, the step of cutting a mounting hole through said support portion wherein said pie shaped segments are separated by radial edges and said narrow annular slots are separated by annular webs, said annular webs terminating at said radial edges.

* * * * *